US007566832B2

(12) United States Patent
Kundinger

(10) Patent No.: US 7,566,832 B2
(45) Date of Patent: Jul. 28, 2009

(54) FLEXIBLE ELECTRICAL CABLE

(75) Inventor: Lothar Kundinger, Fürth (DE)

(73) Assignee: HEW-Kabel/CDT GmbH & Co. KG, Wipperfuerth (DE)

( * ) Notice: Subject to any disclaimer, the term of this patent is extended or adjusted under 35 U.S.C. 154(b) by 0 days.

(21) Appl. No.: 11/976,200

(22) Filed: Oct. 22, 2007

(65) Prior Publication Data

US 2008/0087453 A1 Apr. 17, 2008

Related U.S. Application Data

(63) Continuation-in-part of application No. 11/517,346, filed on Sep. 8, 2006, now abandoned.

(30) Foreign Application Priority Data

Sep. 22, 2005 (DE) ..... 10 2005 045 486
Aug. 3, 2006 (DE) ..... 10 2006 036 621

(51) Int. Cl.
*H01B 7/18* (2006.01)

(52) U.S. Cl. ..... 174/106 R; 174/113 R

(58) Field of Classification Search ..... 174/113 R, 174/102 R, 105 R, 106 R, 36
See application file for complete search history.

(56) References Cited

U.S. PATENT DOCUMENTS

| | | | | |
|---|---|---|---|---|
| 2,109,334 | A | 2/1938 | Heinrich et al. | |
| 2,379,318 | A * | 6/1945 | Safford | 174/107 |
| 3,484,532 | A | 12/1969 | Anderson et al. | |
| 5,171,635 | A | 12/1992 | Randa | |
| 5,349,133 | A * | 9/1994 | Rogers | 174/36 |
| 6,169,251 | B1 | 1/2001 | Grant et al. | |
| 6,963,032 | B2 | 11/2005 | Yamaguchi et al. | |
| 7,038,138 | B2 * | 5/2006 | Laity et al. | 174/113 R |
| 2003/0121694 | A1 * | 7/2003 | Grogl et al. | 174/113 R |
| 2005/0011664 | A1 * | 1/2005 | Lee | 174/102 SC |

FOREIGN PATENT DOCUMENTS

| | | |
|---|---|---|
| GB | 2197115 | 5/1988 |

* cited by examiner

*Primary Examiner*—Chau N Nguyen
(74) *Attorney, Agent, or Firm*—Birch, Stewart, Kolasch & Birch, LLP

(57) ABSTRACT

A highly flexible, screened electrical line for high-frequency data transmission in swiveling display screens provides that the twisted and/or bundled single wires of the line are held by an aluminized nonwoven, and the nonwoven covering is finally surrounded by an outer sheath of silicone rubber.

19 Claims, 2 Drawing Sheets

FLEXIBLE ELECTRICAL CABLE

CROSS-REFERENCE TO RELATED APPLICATIONS

This Application is a continuation-in-part of pending U.S. application Ser. No. 11/517,346 filed on Sep. 8, 2006. This Application claims benefit under 35 USC § 119 of Application No. 10 2005 045 486.0 filed in the Federal Republic of Germany on Sep. 22, 2005, and of Application 10 2006 036 621.2 filed in the Federal Republic of Germany on Aug. 3, 2006, the disclosure of these applications being incorporated herein in their entirety.

BACKGROUND OF THE INVENTION (1) Field of the Invention

This invention relates to the field of electrical cables.

(2) Description of Related Art

The present invention relates to a highly flexible, shielded electrical line for high-frequency data transmission in swiveling display screens, particularly for swiveling LCD (liquid crystal display) devices with two conductors for current supply and/or at least two conductors for data transmission.

In order to take into account the increasing need for information regardless of the specific location of the interested person, the automotive industry, for example, long since developed display screens which are integrated into a vehicle and with the help of which a very wide variety of data can be displayed, whether information on the status of the vehicle itself, telephone connections, radio programs, or route planning (navigation system), particularly in vehicles for passenger transport. However, it is not always possible, for example, in more compact vehicles, to install the screens necessary for displaying information fixed in space in the vehicle, whether the suitable space requirement is not sufficient or the installation location in the automobile allows only a brief view. In such cases, it is necessary to install the screens swivably in the vehicle so that the screens can be folded up or down, swiveled, turned in any direction, or be pulled out from its storage position or, for example, from a drawer, in order to bring them into a position suitable for the viewer. Accordingly, the mechanical requirements for electrical lines, connected to the screens, for data transmission are high. In a swiveling arrangement of the screen, these lines are pulled, stretched, and twisted, limits being rapidly established for the electrical line for pulling, stretching, and twisting without damage, when the ambient temperatures assume very low or high values. Thus, it turned out that, e.g., in areas with permafrost, conventional data lines are not suitable to assure the functioning of the screen. The data lines, becoming stiff at low temperatures, for example, permit neither a folding out nor turning of the screen, and undisturbed data information is no longer possible.

BRIEF SUMMARY OF THE INVENTION

The object of the present invention, therefore, is to propose a data line for the described swiveling screens, which assures the functioning of the screens with undisturbed data receipt as independent as possible from the predominating ambient temperatures.

This object is achieved according to the invention in that the twisted and/or bundled electrical conductors altogether are held by a surrounding wire braid with or without a non-woven fabric beneath the braid, the wire braid is covered by a wrapping of an electrically conducting non-woven fabric and said nonwoven covering is finally surrounded by an outer sheath of silicone rubber. This construction of an electrical data line assures the swiveling of a screen in any direction even under permafrost conditions with simultaneous undisturbed data transmission. A screen connected with a line according to the invention can accordingly be folded forward or backward, turned in one or another direction, or pulled in the direction of the viewer, or moved away again by said viewer without impairing the transmission quality for the specific data.

An electrically conducting metallized non-woven fabric can be a non-woven impregnated with conducting materials, for example, or a non-woven metal coated on one or both sides, whereby the metal used for the coating is aluminum or silver especially. Preferably the non-woven is coated with aluminum or silver by vapor deposition. The flexibility of the data line is substantially improved in this manner also at extremely low temperatures.

An especially advantageous embodiment of the invention arises, however, when the insulation of the signal wires consists of a wrapping of the conductor with a stretched and sintered tape or a film of a non-melt-processable fluoropolymer. This fluoropolymer is usually a polytetrafluoroethylene, whereby the term polytetrafluoroethylene also comprises tetrafluoroethylene polymers that are provided with modifying additives, but in such an amount that the polymers, such as polytetrafluoroethylene itself, is non-melt-processable. This embodiment of the invention not only exhibits high flexibility with dynamic installation over a broad temperature range between −50° C. and +180° C., but is also easily suitable for a transmission frequency above 800 and 1000 MHz and at a shielding effectiveness greater than 65 dB. A further improvement of this data line results when in a continuation of the invention the PTFE (polytetrafluoroethylene) wrapping of the conductor carries a layer of melt-processable fluoropolymer connected frictionally at least with the topmost tape or film layer. Because the ratio of the wall thicknesses of the tape or film wrapping to the frictionally connected layer in carrying out the invention is 3:1, this layer is to be regarded merely as a skin layer covering the wrapping. For example, the tetrafluoro-ethylene/hexafluoropropylene copolymer (FEP), the perfluoroalkoxy polymer (PFA), or also the tetrafluoroethylene/perfluoroalkyl vinyl ether copolymer (TFA/PFA) has proven suitable for this skin layer. But other known melt-processable fluoropolymers as well can at times find advantageous application.

An especially advantageous embodiment of the invention results, however, when the signal wires provided for data transmission and additional wires for the current supply are stranded together. This type of current supply is required, for example, by the adjusting motors at swiveling displays or the drive motors for mirror adjustments in or on vehicles. The electrical conductors, carrying the feeding current, of these wires expediently have an insulation of a melt-processable fluoropolymer. A further advantageous embodiment of the invention results, when the signal wires and the wires for current supply have the same or at least nearly the same outer diameter with the consequence that the both wires can stranded together for having an unit-type electrical line, whereby all stranded wires will have the same bending qualities. The flexibility of the electrical line of the invention will be further improved.

If the signal wires and the wires for current supply are twisted around a central filling strand, the so-called central member, then it has proven especially advantageous in a continuation of the invention to produce the filling strand of a stretched and sintered shaped strand of polytetrafluoroethylene (PTFE). The shaped strand consists advantageously of a PTFE tape twisted into a strand. The advantages of such a shaped strand is its low-temperature flexibility and the absence of material wear, which, as in the case of glass silk central members, easily leads to contamination of the electronic components in the swiveling LCD devices.

If 2, 4, 8, or 10 pairs are held by the wire braid covered by the metallized non-woven fabric of the invention, then to increase the flexibility and transmission properties of the data line it proved advantageous to twist the individual pairs with a different lay length.

The broad temperature range during use of the data line according to the invention demands a suitable sheath material. Here, it proved advantageous to carry out the invention, if the outer sheath is made of a hot-vulcanized silicone rubber, a so-called HTV silicone rubber. Another advantageous option is to choose an LSR (liquid silicone rubber) rubber as the sheath material.

The invention will be described in greater detail with use of the data lines shown as exemplary embodiments in FIGS. 1 to 3. The electrical lines described here are suitable for the low-voltage/high-speed data transmission over copper wires (LVDS) because of their special properties.

DETAILED DESCRIPTION OF THE INVENTION

Figure 1:
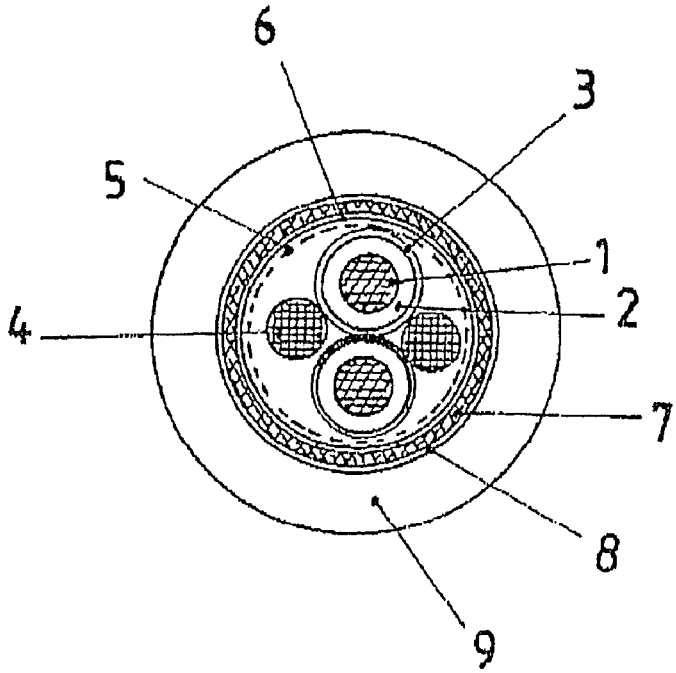
FIG. 1 is a cross-sectional view of a first exemplary embodiment of the invention.

FIG. 1 shows a one-pair screened, highly flexible data line for an EMV-optimized transmission of data (LVDS interface) with extremely high reverse bending ability over a broad temperature range, as can be used advantageously particularly in automotive technology for the connection of swiveling screens. Hereby, copper conductor 1 with a diameter of, e.g., 0.50 mm is insulated with a wrapping 2 of a stretched and sintered tape or a suitable film of polytetrafluoroethylene (PTFE), which is known under the trade name HEI-tape® from the applicant. Wrapping 2 of the PTFE tape carries a skin layer 3 of a melt-processable fluoropolymer, for example, of a tetrafluoroethylene/hexafluoro-propylene copolymer (FEP). Filling strands 4 in the interstices of the twisted single wires serve to stabilize the twisted assembly; they can also be made of a suitable plastic, but can also consist of glass fibers. Twisted assembly 5 having the aforementioned individual elements is surrounded by the taping 6 of an insulating nonwoven. A shield braid, consisting of tinned copper wires, is designated with the number 7; it is covered by the taping 8 of a nonwoven coated on one or both sides with aluminum or silver especially. The outer casing of the data line of the invention is formed by sheath 9 of a hot-vulcanized (HTV) silicone rubber. The outside diameter of this data line, constructed according to the invention, is about 4.5 mm, and the operating voltage according to its use in automotive technology 48 V.

Figure 2:
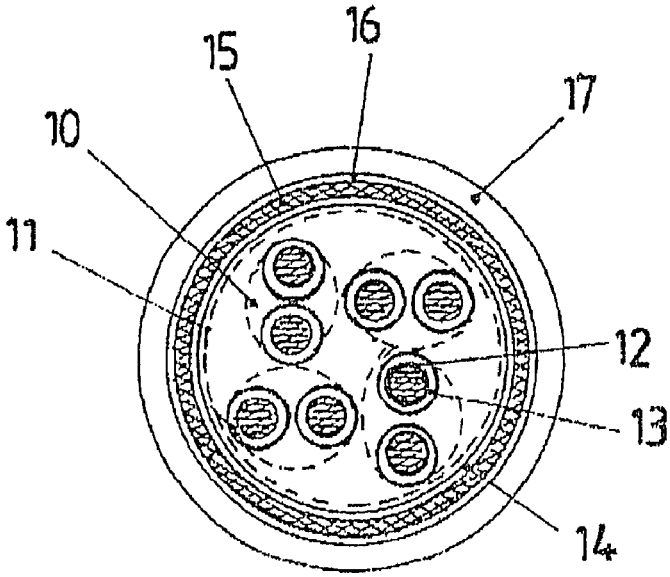
FIG. 2 is a cross-sectional view of a second exemplary embodiment of the invention.

According to the requirements for such data lines, an embodiment of the invention according to FIG. 2 may also be used. In this data line, four pairs 10 are combined into a twisted assembly 11. Electrical conductor 12 of pairs 10 with an outside diameter of, e.g., 0.6 mm in this embodiment consists of bare, tinned, or silvered copper wires. Insulation 13 of conductor 12 consists of a melt-processable aforementioned fluoropolymer, for example, of an FEP. Taping 14 surrounding all four pairs can consist of a film wrapping of an insulating polyester tape, but according to the exemplary embodiment of FIG. 1, an insulating fiber fleece or an insulating non-woven can assume the task of reducing the frictional resistance. Braid 15, which consists of tinned or silvered copper wires is in turn surrounding by taping 16 of a metal coated nonwoven material used for optimizing shielding of the data line. The data line of the invention is sealed outwardly by sheath 17, for example, of an HTV silicone rubber or an LSR rubber.

The silicone rubber sheath, which remains consistently flexible at low temperatures as well, here in connection with the described components of the data line also assures its high reverse bending ability, which allows a dynamic type of installation in swiveling screens or screens that can be pulled out of drawers or covers. In this embodiment of the electrical line, the outside diameter is about 6.0 to 6.5 mm, and the operating voltage is also 48 V.

Figure 3:
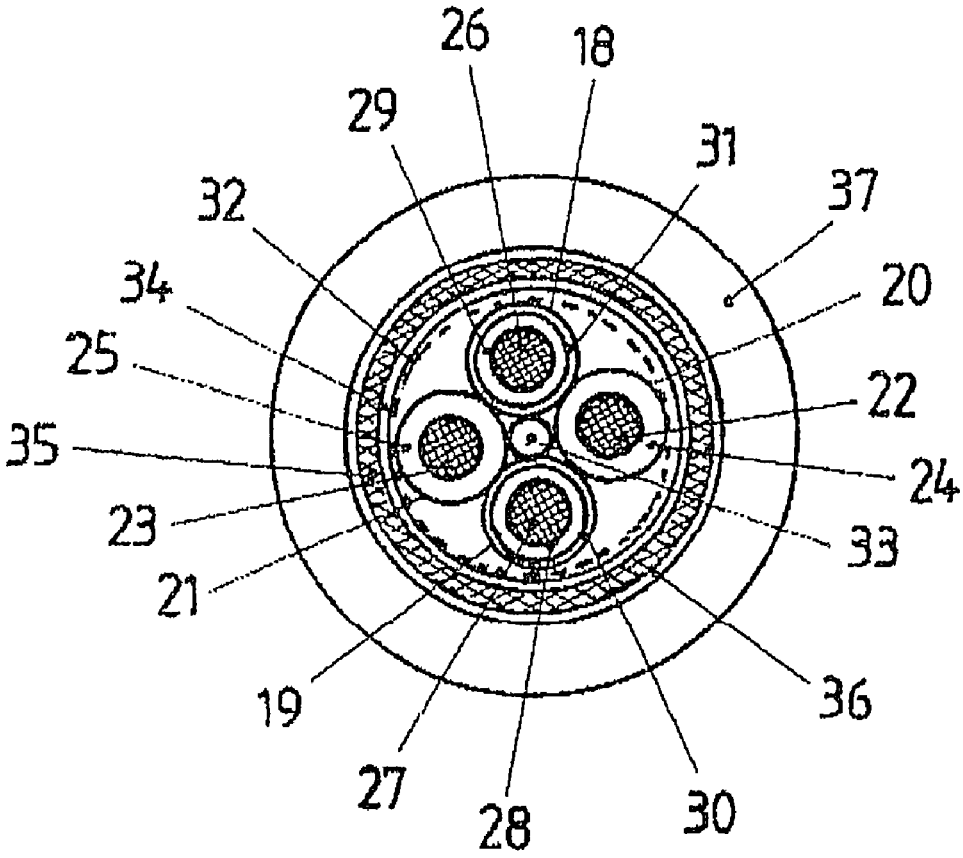
FIG. 3 is a cross-sectional view of a third exemplary embodiment of the invention.

In keeping with FIG. 1, FIG. 3 shows an especially advantageous embodiment of the invention, in which the two single wires 18 and 19 provided for data transmission and the wires 20 and 21 used for the current supply, e.g., for adjusting motors in swiveling screens are stranded together, whereby the outer diameter of all the wires 18, 19, 20 and 21 is at least nearly the same. Because the wires 20 and 21 are not used for data transmission, their electrical conductors 22 and 23 are provided only with insulation 24 or 25 of a melt-processable fluoropolymer, for example, of an FEP.

For data transmission, however, it is a matter of an insulation with a low dielectric constant, e.g., on the order of 1.3. For this reason, conductors 26 and 27 of single wires 18 and 19 are first insulated with a wrapping 28 or 29 of a stretched and sintered tape or of a suitable polytetrafluoroethylene film. These tape or film wrappings are each covered by insulation layers 30 and 31 of a meltable fluoropolymer, in the shown exemplary embodiment of the aforementioned FEP.

Filling strand (central member) 33 is disposed in the center of twisted assembly 32 formed of wires 18, 19, 20, and 21. To increase the flexibility of this line at extremely low temperatures as well, for example, up to −50° C., it consists of a stretched and sintered PTFE tape, twisted into a strand. The use of this material has the advantage, apart from the high low-temperature flexibility of the filling strain of the invention, that contamination by material wear due to movements, to be performed during operation of the line, by the connected swiveling devices is avoided.

Twisted assembly 32 having the aforementioned wires is surrounded by taping 34 of insulating nonwoven to reduce frictional resistance extremely. The insulating nonwoven is covered by shield braid 35, e.g., of tinned copper wires. Moreover corresponding to the invention, a taping 36 of a metallized nonwoven tape is disposed around the shield braid 35 to optimize the screening effect of the braid 35 and the data transmission of the electrical line. The taping 36 may be metal coated on one or both sides, e.g., by vapor deposition of aluminum, silver or other suitable materials. The outer casing of this line of the invention is formed by sheath 37 of a silicone rubber. The outside diameter of this data line according to the invention is about 4.8 mm, and the operating voltage according to its use in automotive technology is 48 V. The special advantage of the line is the problem-free use in a temperature range of about −50° C. to +135° C. and more with a constant high flexibility and an undisturbed data transmission with a data rate of more than 800 or 1000 Mbit/s.

The invention claimed is:

1. A flexible, screened electrical line for high-frequency data transmission in swiveling display screens, comprising:

at least two conductors for current supply and/or at least two conductors for data transmission;

a wire braid surrounding and holding together the at least two conductors for current supply and/or the at least two conductors for data transmission with or without a non-woven fabric beneath the braid;

a wrapping of an electrically conducting metallized non-woven fabric covering the wire braid for optimizing shielding of the at least two conductors for current supply and/or the at least two conductors for data transmission; and an outer sheath of silicone rubber surrounding said metallized non-woven fabric.

2. The electrical line according the claim 1, wherein the at least two conductors for data transmission are at least two pairs each including two twisted signal wires.

3. The electrical line according to claim 2, further comprising:

a wrapping including a stretched and sintered tape or a film of a non-melt-processable fluoropolymer wrapping the at least two conductors for data transmission for insulation of the at least two conductors for data transmission.

4. The electrical line according to claim 3, wherein the non-melt-processable fluoropolymer is a polytetrafluoroethylene.

5. The electrical line according to claim 3, further comprising:

a melt-processable fluoropolymer wrapping covering the at least two conductors for current supply.

6. The electrical line according to claim 3, wherein a ration of wall thicknesses of the wrapping of the at least two conductors for data transmission to a covering covering the wrapping is about 3:1.

7. The electrical line according to claim 2, wherein each individual pair of conductors for data transmission is twisted with a different lay length.

8. The electrical line according to claim 1, wherein the at least two conductors for current supply are stranded together with the at least two conductors for data transmission.

9. The electrical line according to claim 8, further comprising: a melt-processable fluoropolymer insulating cover covering the at least two conductors for current supply.

10. The electrical line according to claim 1, further comprising: a central filling strand around which the at least two conductors for current supply and/or the at least two conductors for data transmission are twisted, the central filling strand including a stretched and sintered shaped strand of polytetrafluoroethylene.

11. The electrical line according to claim 1, wherein the outer sheath is a hot-vulcanized (HTV) silicone rubber.

12. The electrical line according to claim 1, wherein the outer sheath is an LSR (liquid silicone rubber) rubber.

13. The electrical line according to claim 1, wherein the screened electrical line in a dynamic state has a flexibility at temperatures of −50° C. to +180° C. at a transmission frequency >800 MHz.

14. A method of using the electrical line according to claim 1, comprising: transmitting a low-voltage/high-speed data signal (LVDS) over the conductors.

15. The electrical line according to claim 1, wherein the conducting nonwoven fabric is impregnated with conducting materials.

16. The electrical line according to claim 1, wherein the conducting nonwoven fabric of the wrapping is a nonwoven fabric coated with a metal on one or both sides.

17. The electrical line according to claim 16, wherein the metal for coating the nonwoven fabric is aluminum or silver.

18. The electrical line according to claim 16, wherein the nonwoven fabric is coated with aluminum or silver by vapor deposition.

19. A flexible, screened electrical line for high-frequency data transmission in swiveling display screens, comprising:

at least two conductors for current supply and/or at least two conductors for data transmission;

a wire braid surrounding and holding together the at least two conductors for current supply and/or the at least two conductors for data transmission with or without a non-woven fabric beneath the braid;

a wrapping of an electrically conducting metallized non-woven fabric covering the wire braid for optimizing shielding of the at least two conductors for current supply and/or the at least two conductors for data transmission;

an outer sheath of silicone rubber surrounding said metallized non-woven fabric; and a central filling strand around which the at least two conductors for current supply and/or the at least two conductors for data transmission are twisted, the central filling strand including a stretched and sintered shaped strand of polytetrafluoroethylene, wherein the stretched and sintered shaped strand includes a polytetrafluoroethylene tape twisted into a strand.

* * * * *